US008222191B2

(12) United States Patent
Barber

(10) Patent No.: US 8,222,191 B2
(45) Date of Patent: Jul. 17, 2012

(54) METAL CONTAINING HYDRAULIC COMPOSITIONS

(75) Inventor: Allan Barber, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 12/948,804

(22) Filed: Nov. 18, 2010

(65) Prior Publication Data

US 2011/0065617 A1 Mar. 17, 2011

Related U.S. Application Data

(63) Continuation of application No. 11/400,608, filed on Apr. 7, 2006, now abandoned.

(51) Int. Cl.

| | |
|---|---|
| ***C10M 137/10*** | (2006.01) |
| ***C10M 169/04*** | (2006.01) |
| ***C10M 133/56*** | (2006.01) |
| ***C10M 141/10*** | (2006.01) |

(52) U.S. Cl. ..... 508/371; 508/287; 508/293; 508/232; 508/375

(58) Field of Classification Search ..... 508/368, 508/287, 293, 221, 232, 371, 375, 390
See application file for complete search history.

(56) References Cited

U.S. PATENT DOCUMENTS

| | | | |
|---|---|---|---|
| 3,163,603 | A | 12/1964 | LeSuer |
| 3,306,908 | A | 2/1967 | LeSuer |
| 3,649,661 | A | 3/1972 | Otto et al. |
| 4,085,053 | A | 4/1978 | Caspari |
| 4,093,614 | A | 6/1978 | Chibnik et al. |
| 4,179,389 | A | 12/1979 | Mann |
| 4,234,435 | A | 11/1980 | Meinhardt et al. |
| 4,419,251 | A | 12/1983 | Shim et al. |
| 4,419,252 | A | 12/1983 | Shim |
| 4,466,894 | A | 8/1984 | Grover |
| 5,043,083 | A | 8/1991 | Colcord et al. |
| 5,262,073 | A | 11/1993 | Schmitt et al. |
| 5,326,485 | A | 7/1994 | Cervenka et al. |
| 5,849,675 | A | 12/1998 | Brown et al. |
| 6,677,281 | B2 | 1/2004 | Givens, Jr. et al. |
| 2005/0014656 | A1 | 1/2005 | Sumiejski |

FOREIGN PATENT DOCUMENTS

| | | |
|---|---|---|
| WO | 9303212 | 2/1993 |
| WO | 9635765 | 11/1996 |

*Primary Examiner* — Walter D Griffin
*Assistant Examiner* — Vishal Vasisth
(74) *Attorney, Agent, or Firm* — Christopher D. Hilker; David M. Shold

(57) ABSTRACT

The present invention relates to a lubricating composition containing an oil of lubricating viscosity, a metal containing antiwear agent and a metal containing dispersant. The invention further provides for a method for lubricating a hydraulic system.

11 Claims, No Drawings

METAL CONTAINING HYDRAULIC COMPOSITIONS

This application is a continuation of prior application U.S. Ser. No. 11/400,608 now abandoned filed Apr. 7, 2006 and claims the benefit of said prior application.

FIELD OF INVENTION

The present invention relates to a lubricating composition containing an oil of lubricating viscosity, a metal containing antiwear agent and a metal containing dispersant. The invention further provides for a method for lubricating a mechanical device such as a hydraulic system.

BACKGROUND OF THE INVENTION

It is known to employ a metal containing antiwear agent such as zinc dialkyl dithiophosphate in a lubricating composition suitable for a hydraulic system, circulating oil or another industrial oil. However zinc dialkyl dithiophosphate forms deposits such as resins, sludges and varnish in the hydraulic system. These deposits impair the performance of the hydraulic systems by causing valve sticking and unresponsive control. Additionally, the cleaning of these systems is difficult since the deposits are difficult to remove without mechanical abrasion.

International publication WO96/035765 discloses a lubricating composition with a rust reducing or preventing amount of 0.1 to 3 wt % of a metal synthetic aryl sulphonate and 0.01 to 2 wt % of an aliphatic succinic acid or anhydride. Further the use of substituted polyisobutylene succinic acid or anhydride derivatives of polyol esters or polyamines are excluded because lubricating compositions that contain said additive do not exhibit acceptable rust resistance properties.

U.S. Pat. Nos. 4,419,251 and 4,419,252 disclose aqueous lubricants with oil-in-water characteristics containing a dispersant/emulsifier system and an antiwear/rust inhibiting package.

U.S. Pat. No. 5,262,073 discloses a lubricating composition containing a zinc dispersant, 0.3 to 1 wt % of calcium nonyl di-naphthalene synthetic sulphonate detergent and 0.09 to 0.85 wt % of calcium alkylphenate.

U.S. Pat. No. 6,677,281 discloses a lubricating composition containing a metal sulphonate, an ashless alkenyl succinimide and a borated polyolefin dispersant.

U.S. Pat. No. 4,466,894 discloses a composition containing metal salts of phosphorus thio-alcohols, a sulphurised phenate, and a benzotriazole.

International publication WO 93/03121 discloses a metal salt of at least one of a sulphonate, a carboxylate and a phenate, in combination with an aliphatic carboxylic acid or anhydride thereof.

It would be desirable for a lubricating composition to provide acceptable wear performance whilst reducing or preventing deposit formation. The present invention provides a lubricating composition with acceptable wear performance whilst reducing or preventing deposit formation.

SUMMARY OF THE INVENTION

The present invention in one embodiment provides a lubricating composition comprising:

(a) an oil of lubricating viscosity;

(b) a metal containing dispersant;

(c) a metal di-hydrocarbyl-substituted dithiophosphate, wherein at least one hydrocarbyl group is a branched primary hydrocarbyl group; and (d) optionally one or more additives comprising a detergent, an antioxidant, a corrosion inhibitor, a carboxylic acid or anhydride, or mixtures thereof.

In one embodiment the invention provides a process for preparing a lubricating composition, wherein the process comprises admixing:

(a) an oil of lubricating viscosity;

(b) a metal containing dispersant;

(c) a metal di-hydrocarbyl-substituted dithiophosphate, wherein at least one hydrocarbyl group is a branched primary hydrocarbyl group; and (d) optionally one or more additives comprising a detergent, an antioxidant, a corrosion inhibitor, a carboxylic acid or anhydride, or mixtures thereof.

In one embodiment the invention provides a method for lubricating a mechanical device requiring a hydraulic system, circulating oil or another industrial oil, the method comprising supplying the mechanical device with a lubricating composition comprising:

(a) an oil of lubricating viscosity;

(b) a metal containing dispersant;

(c) a metal di-hydrocarbyl-substituted dithiophosphate, wherein at least one hydrocarbyl group is a branched primary hydrocarbyl group; and (d) optionally one or more additives comprising a detergent, an antioxidant, a corrosion inhibitor, a carboxylic acid or anhydride, or mixtures thereof.

DETAILED DESCRIPTION OF THE INVENTION

The present invention provides a lubricating composition and method as defined above.

As used herein the term 'substantially free of' means the lubricating composition contains not more than contaminant amounts of water, for example water present at less than about 2 wt %, preferably less than about 1 wt %, or even about 0.5 wt % or less of the lubricating composition.

It should however be noted that during application of the lubricating composition in industrial fluids, hydraulic fluids, turbine oils, circulating oils, or combinations thereof, extraneous water may be incorporated into the system. The extraneous water is not included in the contaminant amounts of water disclosed above.

In one embodiment the lubricating composition is substantially free of, to the absence of water. In one embodiment the lubricating composition is not an oil-in water emulsion.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≦0.03 wt %, and ≧90 wt % saturates, viscosity index 80-120); Group III (sulphur content ≦0.03 wt %, and ≧90 wt % saturates, viscosity index ≧120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group I, Group II, Group III oil or mixtures thereof.

The oil of lubricating viscosity may be present in ranges from about 69.5 to about 99.9 wt %, or from about 86 to about 99.9 wt %, or from about 89.9 to about 99.7 wt %.

The lubricating composition may be in the form of a concentrate and/or a fully formulated lubricant. If the lubricating composition of the present invention is in the form of a concentrate (which may be combined with additional oil to form, in whole or in part, a finished lubricant), the ratio of the additives (a) to (d) to the oil of lubricating viscosity and/or to diluent oil include the ranges of about 1:99 to about 99:1 by weight, or from about 80:20 to about 10:90 by weight.

Metal Containing Dispersant

The metal containing dispersant may be present in ranges from about 0.01 to about 5 wt %, or from about 0.05 to about 2.5 wt %, or from about 0.1 to about 1.5 wt %. In different embodiments the metal containing dispersant is present at about 0.2 wt %, about 0.3 wt %, about 0.5 wt %, about 0.7 wt %, about 0.9 wt %, or about 1.1 wt %.

The metal of the metal containing dispersant comprises zinc, copper, magnesium, barium or calcium. In one embodiment the metal is zinc.

The dispersant may include N-substituted long chain alkenyl succinimides or long chain alkenyl esters, partial esters or salts thereof.

Examples of N-substituted long chain alkenyl succinimides include polyisobutylene succinimide with number average molecular weight of the polyisobutylene substituent in the range about 350 to about 5000, or about 500 to about 3000.

The long chain alkenyl esters, partial esters or salts thereof may be prepared by reacting an alkenyl substituted acylating agent (such as a polyisobutylene succinic acid) with a polyol.

Examples of a suitable polyol include ethylene glycol, propylene glycol, butylene glycol, pentaerthyritol, mannitol, sorbitol, glycerol, di-glycerol, tri-glycerol, tetra-glycerol, erythritol, 2-hydroxymethyl-2-methyl-1,3-propanediol (trimethylolethane), 2-ethyl-2-(hydroxymethyl)-1,3-propanediol (trimethylolpropane), 1,2,4-hexanetriol and mixtures thereof.

The succinimide may be prepared from a polyamine. Suitable polyamines include alkylenediamine, a polyalkylenepolyamine such as a polyethylenepolyamine, or a mixture thereof. Useful examples of polyamines are ethylenediamine, propylenediamine, 1,3-diaminopropane, N-methylethylenediamine, diethylenetriamine, triethylenetetramine, tetraethylenepentamine, tris(2-aminoethyl)amine, and polyethylenepolyamine bottoms (HPAX® amines commercially produced by Dow Chemicals).

In one embodiment the invention further comprises at least one dispersant derived from polyisobutylene, an amine and zinc oxide to form a polyisobutylene succinimide complex or salt with a zinc compound or cation. The polyisobutylene succinimide complex with zinc may be used alone or in combination with other dispersants. Methods of preparing polyisobutylene succinimide complex with zinc are described in more detail in U.S. Pat. No. 3,636,603.

Metal Di-Hydrocarbyl Substituted Dithiophosphate

The metal dihydrocarbyl dithiophosphate contains at least one branched hydrocarbyl group. The hydrocarbyl dithiophosphate includes those represented by the formula:

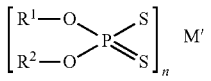

wherein M' comprises a metal; and both $R^1$ and $R^2$ are hydrocarbyl groups or mixtures thereof, with the proviso that at least one of $R^1$ and $R^2$ is a branched primary hydrocarbyl group, or mixtures thereof.

In one embodiment both $R^1$ and $R^2$ are branched primary hydrocarbyl groups.

Each branched hydrocarbyl group may contain about 6 to about 20, or about 8 to about 16, or about 8 to about 14 carbon atoms. Examples of a suitable branched hydrocarbyl group include 2-ethylhexyl, iso-octyl, iso-nonyl, iso-decyl, iso-dodecyl, iso-pentadecyl, 2-methyl-1-pentyl, isobutyl, 2-propyl-1-decyl or mixtures thereof. In one embodiment the branched hydrocarbyl group comprises at least one of 2-ethylhexyl, iso-nonyl, iso-decyl, or mixtures thereof.

When only one of $R^1$ and $R^2$ is branched, the non-branched group may be linear alkyl or aryl.

In one embodiment both $R^1$ and $R^2$ are branched.

M' is a metal, and n is an integer equal to the available valence of M'. M' is mono- or di- or tri-valent, in one embodiment divalent and in another embodiment a divalent transition metal. In one embodiment M' is zinc. In one embodiment M' is calcium. In one embodiment M' is barium. Examples of a metal hydrocarbyl dithiophosphate include zinc dihydrocarbyl dithiophosphates (often referred to as ZDDP, ZDP or ZDTP).

The metal dihydrocarbyl dithiophosphate may be present in the lubricating composition in ranges from about 0.01 to about 5 wt %, or from about 0.1 to about 2 wt %, or from about 0.2 to about 1 wt %. In different embodiments the metal dihydrocarbyl dithiophosphate is present at about 0.3 wt %, or about 0.5 wt %, or about 0.7 wt %, or about 0.9 wt %.

The lubricant composition optionally comprises optionally one or more additives comprising a detergent, an antioxidant, a corrosion inhibitor, a carboxylic acid or anhydride, or mixtures thereof.

Detergents

The lubricant composition optionally further comprises known neutral or overbased detergents i.e. ones prepared by conventional processes known in the art. Suitable detergent substrates include, phenates, sulphur containing phenates, sulphonates, salixarates, salicylates, carboxylic acid, phosphorus acid, mono- and/or di-thiophosphoric acid, alkyl phenol, sulphur coupled alkyl phenol compounds, or saligenins.

The detergent may be natural or synthetic. In one embodiment the detergent is synthetic.

In one embodiment the detergent comprises a sulphonate detergent. The sulphonate detergent may also have corrosion inhibitor properties.

The sulphonate detergent of the composition includes compounds represented by the formula:

$$(R^1)_k\text{-A-SO}_3\text{M} \quad \text{(I)}$$

wherein each $R^1$ is a hydrocarbyl group in one embodiment containing about 6 to about 40, or from about 8 to about 35, or from about 8 to about 30 carbon atoms; A may be independently a cyclic or acyclic divalent or multivalent hydrocarbon group; M is hydrogen, a valence of a metal ion, an ammonium ion or mixtures thereof; and k is an integer of 0 to about 5, for example 0, 1, 2, 3, 4, 5. In one embodiment k is 1, 2 or 3, in another embodiment 1 or 2 and in another embodiment 2.

In one embodiment k is 1 and $R^1$ is a branched alkyl group with about 6 to about 40 carbon atoms. In one embodiment k is 1 and $R^1$ is a linear alkyl group with about 6 to about 40 carbon atoms.

Examples of suitable $R^1$ linear alkyl group include octyl, nonyl, decyl, undecyl, dodecyl, pentadecyl, hexadecyl, eicosyl, or mixtures thereof.

When M is a valence of a metal ion, the metal may be monovalent, divalent, trivalent or mixtures of such metals. When monovalent, the metal M includes an alkali metal such as lithium, sodium, or potassium, and when divalent, the metal M includes an alkaline earth metal such as magnesium, calcium or barium. In one embodiment the metal is an alkaline earth metal. In one embodiment the metal is calcium.

When A is cyclic hydrocarbon group, suitable groups include phenylene or fused bicyclic groups such as naphthylene, indenylene, indanylene, bicyclopentadienylene or mixtures thereof. In one embodiment A comprises a naphthylene ring.

In different embodiments the detergent is neutral or overbased. In one embodiment the detergent is neutral.

Examples of a suitable detergent include at least one of calcium dinonyl naphthalene sulphonate, calcium didecyl naphthalene sulphonate, didodecyl naphthalene sulphonate, calcium dipentadecyl naphthalene sulphonate, or mixtures thereof. In one embodiment the detergent comprises neutral or slightly overbased calcium dinonyl naphthalene sulphonate, or mixtures thereof.

The detergent may be present in the lubricating composition in ranges from 0 to about 3 wt %, or from about 0.001 to about 1.5 wt %, or from about 0.01 to about 0.75 wt %. In different embodiments the detergent may be present at about 0.08 wt %, or about 0.1 wt %, or about 0.2 wt %, or about 0.4 wt % or about 0.6 wt % of the lubricating composition.

Antioxidant

Antioxidant compounds are known and include sulphurised olefins, alkylated diphenylamines, hindered phenols, molybdenum dithiocarbamates, and mixtures thereof. Antioxidant compounds may be used alone or in combination with other antioxidants.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, or 2,6-di-tert-butylphenol. In one embodiment the hindered phenol antioxidant is an ester and may include, e.g., Irganox™ L-135 from Ciba. Suitable examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

The antioxidant may be present in the lubricating composition in ranges from 0 to about 3 wt %, or from about 0.01 to about 1.5 wt %, or from about 0.05 to about 0.8 wt %.

Corrosion Inhibitor

The lubricating composition optionally further comprises a corrosion inhibitor. Examples of a corrosion inhibitor include benzotriazoles, 1,2,4-triazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyl-dithio)-1,3,4-thiadiazoles, 2,5-bis(N,N-dialkyldithiocarbamoyl)-1,3,4-thiadiazoles, 2-alkyldithio-5-mercapto thiadiazoles or mixtures thereof. In one embodiment the corrosion inhibitor is benzotriazole. In one embodiment the corrosion inhibitor is a 2,5-bis(alkyl-dithio)-1,3,4-thiadiazole. The corrosion inhibitor may be used alone or in combination with other corrosion inhibitors.

Benzotriazoles may contain hydrocarbyl substitutions on at least one of the following ring positions 1- or 2- or 4- or 5- or 6- or 7-. The hydrocarbyl groups may contain 1 to about 30, or 1 to about 15, or 1 to about 7 carbon atoms. In one embodiment the corrosion inhibitor is tolyltriazole. In one embodiment hydrocarbyl benzotriazoles substituted at positions 4- or 5- or 6- or 7- can be further reacted with an aldehyde and a secondary amine.

Examples of suitable hydrocarbyl benzotriazoles further reacted with an aldehyde and a secondary amine include N,N-bis(heptyl)-ar-methyl-1H-Benzotriazole-1-methanamine, N,N-bis(nonyl)-ar-methyl-1H-Benzotriazole-1-methanamine, N,N-bis(decyl)-ar-methyl-1H-Benzotriazole-1-methanamine, N,N-bis(undecyl)-ar-methyl-1H-Benzotriazole-1-methanamine, N,N-bis(dodecyl)-ar-methyl-1H-Benzotriazole-1-methanamine N,N-bis(2-ethylhexyl)-ar-methyl-1H-Benzotriazole-1-methanamine and mixtures thereof. In one embodiment the corrosion inhibitor is N,N-bis(2-ethylhexyl)-ar-methyl-1H-Benzotriazole-1-methanamine.

In one embodiment, the corrosion inhibitor is 2,5-bis(alkyl-dithio)-1,3,4-thiadiazoles. The alkyl groups of 2,5-bis(alkyl-dithio)-1,3,4-thiadiazoles contains 1 to about 30, or about 2 to about 25, or 4 to about 20, or about 6 to about 16 carbon atoms. Examples of suitable 2,5-bis(alkyl-dithio)-1,3,4-thiadiazoles include 2,5-bis(tert-octyldithio)-1,3,4-thiadiazole, 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, or mixtures thereof.

The corrosion inhibitor may be present in ranges from about 0 to about 1.5, or from about 0.0003 to about 1.5, or from about 0.0005 to about 0.5, or from about 0.001 to about 0.1 weight percent of the lubricating composition.

Carboxylic Acid or Anhydride

The carboxylic acid or anhydride thereof may contain about 10 to about 400, or about 20 to about 200, or about 30 to about 150 carbon atoms.

The carboxylic acid or anhydride thereof may be derived from a polyolefin. The polyolefin may be a homopolymer, copolymer, or interpolymer. The polyolefin may be prepared from polymerisable monomers containing about 2 to about 16, or about 2 to about 8, or about 2 to about 6 carbon atoms. Often the polymerisable monomers comprise one or more of propylene, isobutene, 1-butene, isoprene, 1,3-butadiene, or mixtures thereof.

In one embodiment the carboxylic acid or anhydride thereof comprises a succinic acid or anhydride thereof.

In one embodiment the carboxylic acid or anhydride thereof comprises a polyisobutylene succinic acid or anhydride thereof. A more detailed description of a suitable carboxylic acid or anhydride thereof is described in WO 93/03121, page 33, line 10 to page 37, line 20.

The carboxylic acid or anhydride thereof may be present in ranges from 0 to about 3 wt %, or from about 0.0001 to about 3 wt %, or from about 0.001 to about 1 wt %, or from about 0.01 to about 0.5 wt % of the lubricating composition.

Other Performance Additives

Optionally the lubricating composition further comprises at least one of rust inhibitors, foam inhibitors, demulsifiers, friction modifiers, viscosity modifiers, pour point depressants or mixtures thereof. The total combined amount of foam inhibitors, demulsifiers, friction modifiers, viscosity modifiers, pour point depressants may range from 0 to about 10 wt %, or from 0 to about 5 wt %, or from about 0.0001 to about 1 wt % of the lubricating composition.

Rust inhibitors include amine salts of carboxylic acids (such as octylamine octanoate, condensation products of dodecenyl succinic acid or anhydride and a fatty acid such as oleic acid with a polyamine, e.g. a polyalkylene polyamine such as triethylenetetramine, and half esters of alkenyl succinic acids in which the alkenyl radical contains about 8 to about 24 carbon atoms with alcohols such as polyglycols. The rust inhibitors can be used alone or in combination with other rust inhibitors.

Viscosity modifiers include hydrogenated styrene-butadiene rubbers, ethylene-propylene copolymers, hydrogenated styrene-isoprene polymers, hydrogenated diene polymers, polyalkyl styrenes, polyolefins, polyalkyl (meth)acrylates and esters of maleic anhydride-styrene copolymers, or mixtures thereof.

Foam inhibitors include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, poly(meth)acrylates, polyacrylates or polyacrylamides; and friction modifiers including fatty acid derivatives such as amines, esters, epoxides, fatty imidazolines, condensation products of carboxylic acids and polyalkylene-polyamines and amine salts of alkylphosphoric acids may also be used in the lubricant composition.

In one embodiment the lubricating composition comprises (a) about 86 to about 99.9 wt % of an oil of lubricating viscosity, (b) about 0.05 to about 2.5 wt % of a metal containing dispersant, (c) about 0.1 to about 2 wt % of a metal di-hydrocarbyl-substituted dithiophosphate, wherein at least one hydrocarbyl group is branched, (d) about 0.001 to about 1.5 wt % of a detergent, (e) about 0.01 to about 1.5 wt % of an antioxidant, (f) about 0.0005 to about 1 wt % of a corrosion inhibitor, (g) about 0.001 to about 1 wt % of a carboxylic acid or anhydride; and (h) 0 to about 5 wt % of other performance additives.

INDUSTRIAL APPLICATION

The method and lubricating composition of the invention may be suitable industrial fluids, hydraulic fluids, turbine oils, circulating oils, or combinations thereof.

In different embodiments the lubricating composition is suitable for various mechanical devices including industrial systems, hydraulic systems or turbines. In one embodiment the lubricating composition is suitable for a hydraulic system.

The following examples provide an illustration of the invention. These examples are non exhaustive and are not intended to limit the scope of the invention.

EXAMPLES

Lubricating compositions (Examples A to C) are prepared as shown in the following Table.

| | Amounts of Components in Lubricating Composition (wt %) | | |
|---|---|---|---|
| | Example A | Example B | Example C |
| Base Oil | 99.3 | 98.6 | 97.5 |
| Zinc containing succinimide | 0.1 | 0.3 | 0.5 |
| Primary ZDDP | 0.5 | 0.8 | 1.5 |
| Total amount of additives* | 0.2 | 0.3 | 0.5 |

*Additives include one or more of Detergents, Antioxidants, Demulsifiers, Antifoam agents, Corrosion inhibitors and polyisobutylene succinic anhydride A series of tests are performed on Examples A to C to determine how effective the lubricating compositions are for hydraulic systems.

Test 1 is a Modified Eaton Vickers 35VQ25 pump test according to M-2950-S but the test runs for 1,000 hours. At the end of the test no varnish is observed in the oil reservoir or other parts of the system.

Test 2 is the T6H20C hybrid pump test in accordance with Parker Hannifin A-TP-30533.

Test 3 determines the ability of the lubricating compositions to produce reduced amounts of sludge. The test uses the Cincinnati Lamb Landis procedure 'A' thermal stability test. The amount of sludge formed is about 1.8 mg. This level of sludge is considered to be very low for contemporary fluid technology.

Test 4 is the DIN 51 354 FZG scuffing test. The Examples A to C fail at load stage 12.

Tests 5 and 6 determine the hydrolytic stability (by ASTM D2619) and demulsibility performance (by ASTM D1401) respectively for Examples A to C. The results obtained indicate the examples are hydrolytically stable and have good demulsibility performance.

Test 7 evaluates the lifetime Turbine Oil Stability Test by ASTM D943. The results obtained for Examples A to C are improved over a commercially available comparative example containing zinc dialkyl dithiophosphate. The commercially available product has a lifetime of about 2,000 hours whilst the lubricating composition of the invention has a lifetime of over 3,500 hours.

The data demonstrates that the lubricating composition of the invention provides industrial fluids, hydraulic fluids, turbine oils, circulating oils, or combinations thereof, with at least one of a reduction or prevention of resin formation, sludge formation, and varnish formation. The lubricating compositions also provide at least one of acceptable antiwear performance and cleanliness.

In this specification the terms "hydrocarbyl substituent" or "hydrocarbyl group," as used herein are used in its ordinary sense, which is well-known to those skilled in the art. Specifically, it refers to a group primarily composed of carbon and hydrogen atoms and is attached to the remainder of the molecule through a carbon atom and does not exclude the presence of other atoms or groups in a proportion insufficient to detract from the molecule having a predominantly hydrocarbon character. In general, no more than two, preferably no more than one, non-hydrocarbon substituent will be present for every ten carbon atoms in the hydrocarbyl group; typically, there will be no non-hydrocarbon substituents in the hydrocarbyl group. A more detailed definition of the terms "hydrocarbyl substituent" or "hydrocarbyl group," is described in U.S. Pat. No. 6,583,092.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for lubricating a mechanical device, wherein the mechanical device is a hydraulic system or a turbine, the method comprising supplying the mechanical device with a lubricating composition comprising:

(a) an oil of lubricating viscosity;

(b) about 0.1 to about 1.5 wt % of a metal containing dispersant, wherein the metal is zinc, and wherein the metal containing dispersant is a N-substituted long chain alkenyl succinimide or long chain alkenyl ester, partial ester or salt thereof;

(c) about 0.2 to about 1 wt % of a metal di-hydrocarbyl-substituted dithiophosphate, wherein at least one hydrocarbyl group is a 2-ethylhexyl group, and wherein the metal is zinc; and (d) optionally one or more additives comprising a detergent, an antioxidant, a corrosion inhibitor, a carboxylic acid or anhydride, or mixtures thereof.

2. The method of claim 1, wherein the mechanical device is a hydraulic system.

3. The method of claim 1, wherein the metal containing dispersant comprises polyisobutylene succinimide complex or salt with a zinc compound or cation.

4. The method of claim 1, wherein the metal di-hydrocarbyl-substituted dithiophosphate comprises those represented by the formula:

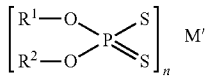

wherein M' comprises zinc; and both $R^1$ and $R^2$ are hydrocarbyl groups, with the proviso that at least one of $R^1$ and $R^2$ is a 2-ethylhexyl group.

5. The method of claim 4, wherein both $R^1$ and $R^2$ are 2-ethylhexyl groups.

6. The method of claim 1, wherein the lubricating composition further comprises one or more additives from a detergent, an antioxidant, a corrosion inhibitor, a carboxylic acid or anhydride, or mixtures thereof.

7. The method of claim 6, wherein the detergent comprises at least one of calcium dinonyl naphthalene sulphonate, calcium didecyl naphthalene sulphonate, didodecyl naphthalene sulphonate, calcium dipentadecyl naphthalene sulphonate, or mixtures thereof.

8. The method of claim 6, wherein the corrosion inhibitor comprises a benzotriazoles, 1,2,4-triazoles, or mixtures thereof.

9. The method of claim 6, wherein the carboxylic acid or anhydride comprises polyisobutylene succinic acid or anhydride thereof, or mixtures thereof.

10. The method of claim 6, wherein the antioxidant comprises a hindered phenol, or mixtures thereof.

11. The method of claim 1, wherein the lubricating composition comprises:

(a) about 86 to about 99.9 wt % of an oil of lubricating viscosity;

(b) about 0.1 to about 1.5 wt % the metal containing dispersant;

(c) about 0.2 to about 1 wt % of the metal di-hydrocarbyl-substituted dithiophosphate, wherein at least one hydrocarbyl group is a 2-ethylhexyl group;

(d) about 0.001 to about 1.5 wt % of a detergent;

(e) about 0.01 to about 1.5 wt % of an antioxidant;

(f) about 0.0005 to about 1 wt % of a corrosion inhibitor;

(g) about 0.001 to about 1 wt % of a carboxylic acid or anhydride; and (h) 0 to about 5 wt % of other performance additives.

* * * * *